United States Patent [19]

Machler

[11] Patent Number: 4,502,260

[45] Date of Patent: Mar. 5, 1985

[54] CORNER FASTENER

[76] Inventor: David C. Machler, 9815 Sheehan Rd., Centerville, Ohio 45459

[21] Appl. No.: 555,512

[22] Filed: Nov. 28, 1983

[51] Int. Cl.[3] ..... E04C 2/38

[52] U.S. Cl. ..... 52/656; 52/202

[58] Field of Search ..... 52/656, 202, 203, 213, 52/214; 49/61, 62

[56] References Cited

U.S. PATENT DOCUMENTS

| | | | |
|---|---|---|---|
| 2,612,947 | 10/1952 | Jenks | 52/203 X |
| 2,770,335 | 11/1956 | Sylvan | 52/214 |
| 2,814,078 | 11/1957 | Durr | 52/202 X |
| 3,293,803 | 12/1966 | Boassy et al. | 52/656 X |
| 3,342,514 | 9/1967 | Ivanhoe et al. | 52/656 X |
| 3,604,739 | 9/1971 | Carlisle | 52/656 X |
| 3,709,533 | 1/1973 | Walters | 52/656 X |
| 3,866,380 | 2/1975 | Benson | 52/656 |
| 4,136,496 | 1/1979 | Molyneux | 52/656 X |
| 4,240,765 | 12/1980 | Offterclinger | 52/656 X |

*Primary Examiner*—Carl D. Friedman
*Attorney, Agent, or Firm*—Ralph L. Marzocco

[57] ABSTRACT

A corner fastener is disclosed for joining angularly oriented tubular members concomitantly forming a corner of a frame assembly. Moreover, resilient fingers and hemispherically-shaped nipples of corner fasteners respectively facilitate securement of frame assemblies to window frames and provide breather-space separation of frame assemblies from window frames.

15 Claims, 10 Drawing Figures

CORNER FASTENER

BACKGROUND OF THE INVENTION

1. Field of the Invention

The present invention relates generally to a device for eliminating miter joints in a frame assembly. More particularly, the invention relates to a corner fastener for adjoining tubular members of a frame assembly used in the construction of windows, window screens, picture frames, and the like.

2. Description of the Prior Art

Heretofore, windows, window screens, picture frames, and the like are manufactured by miter cutting a length of hollow tubular material by means of two rotary saws positioned at a 90° angle with respect to each other. Of necessity due to the position of the two saws, approximately two inches of waste material are created with each cut or about eight inches per four-sided frame. A corner key (a pair of perpendicularly oriented legs with each leg being arranged to fit within the hollow interior of a respective tubular member) effects the interconnection of the tubular members at right angles to each other.

Storm windows, window screens, and the like are usually secured to conventional window frames by means of various types of metal tabs. However such method of securement has the disadvantage of not permitting easy removal of storm windows, window screens, and the like for cleaning and maintenance purposes. Additionally, storm windows, window screens, and the like are not provided with means for permitting the removal of water of condensation that can form and collect, for example, between a window frame and a window screen causing material damage and deterioration problems. And picture frames are not provided with means for minimizing the scratching and marring of surfaces on which such frames rest.

SUMMARY OF THE INVENTION

The present invention provides a corner fastener of a frame assembly for joining angularly oriented members and concomitantly for forming a corner thereof. In a preferred embodiment the corner fastener comprises a pair of legs perpendicular to one another with each leg being arranged to securely fit within the hollow interior of tubular material effectuating the perpendicular interconnection of tubular material to one another. In another form of the preferred embodiment a resilient finger is adjoined to a corner fastener to provide easy securement to and subsequent removal of a frame assembly from a window frame. And in yet another form of the preferred embodiment a hemispherically-shaped nipple is adjoined to a corner fastener to provide a spacer to separate the frame assembly from an underlying surface area.

It is therefore an object of the present invention to provide a device for eliminating miter joints in the construction of a frame assembly thereby minimizing wastage of tubular material used therein.

It is a further object of the invention to provide a device for interconnecting angularly oriented tubular members to each other and concomitantly forming a corner of a frame assembly.

Still another object of the invention is to provide a device for facilitating the installation and removal of a frame assembly from a window frame.

Yet another object of the invention is to provide a device for minimizing the amount of surface contact a frame assembly has with an underlying support.

Achievement of the above and other objects and advantages which will be apparent from a reading of the following disclosure and overcoming of the shortcomings and disadvantages of prior art devices have preceded in the case of the present invention from the discovery by the instant inventor that frame assemblies which are simple to build, inexpensive, and rigid may be constructed using corner forming connectors having projecting resilient fingers and corner forming connectors having hemispherically-shaped nipples.

BRIEF DESCRIPTION OF THE DRAWINGS

For a further understanding of the nature and objects of the invention, reference should be had to the detailed description of the exemplary embodiments taken in connection with the appended drawings in which.

DESCRIPTION OF THE PREFERRED EMBODIMENTS

Figure 1:
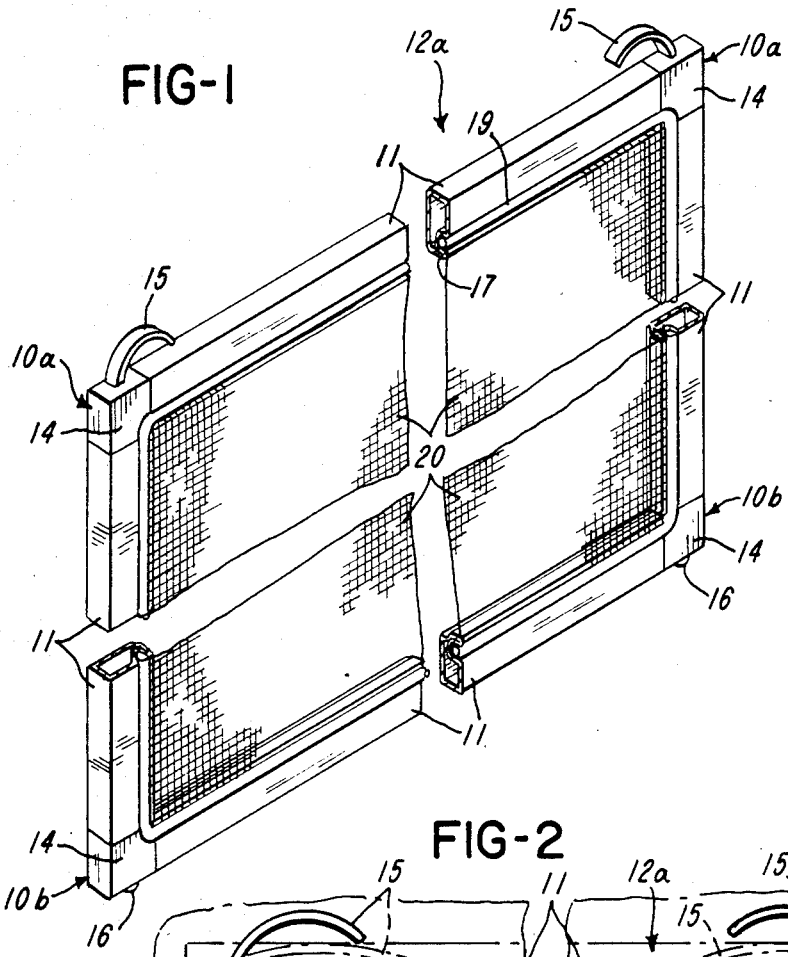
FIG. 1 is a fragmentary perspective view showing the device of this invention used in the construction of a window screen.

Referring to the several figures of the drawings wherein like reference numerals refer to like parts, the device of this invention, corner fastener 10*a*, 10*b*, 10*c*, may be fabricated from a suitable metal such as aluminum, copper, steel or the like or from a suitable plastic such as polyvinyl chloride (geon), polytetrafluoroethylene (teflon), polymethylmethacrylate (lucite) or the like.

Corner fastener 10*a*, 10*b*, 10*c* is made to interconnect a pair of enlongated tubular members 11 to each other to form a segment of a frame assembly 12*a*, 12*b*. Elongated tubular member 11 has a hollow internal space formed by two vertically oriented side walls and two horizontally oriented cross members. Corner fastener 10*a*, 10*b*, 10*c* comprises a pair of legs 13 connected to each other at junction member 14. Legs 13 are U-shaped and are adapted for disposition within the interior spatial area of elongated tubular members 11 to effect the securement of corner fastener 10*a*, 10*b*, 10*c* thereto and the concomitant securement of elongated tubular members 11 to each other.

Figure 3:
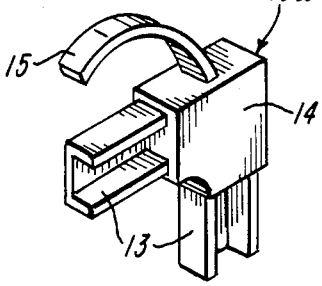
FIG. 3 is a perspective view of one form of the device of this invention.

Junction member 14, which appears as a visible corner-piece in frame assembly 12*a*, 12*b*, has its external walls contiguous with the external walls of elongated tubular members 11. Additionally, junction member 14 is shouldered to serve as a stop for elongated tubular member 11. Projecting outwardly and curving medially from junction member 14 is resilient finger 15, a pair of which are located at the two uppermost corners of frame assembly 12*a*. In this embodiment of the device of the invention corner fastener 10*a* is best seen in the perspective view of FIG. 3.

Figure 4:
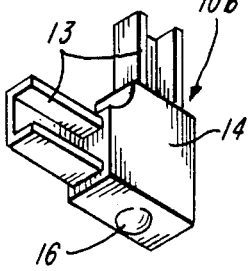
FIG. 4 is a perspective view of an alternate form of the device of this invention.
Figure 2:
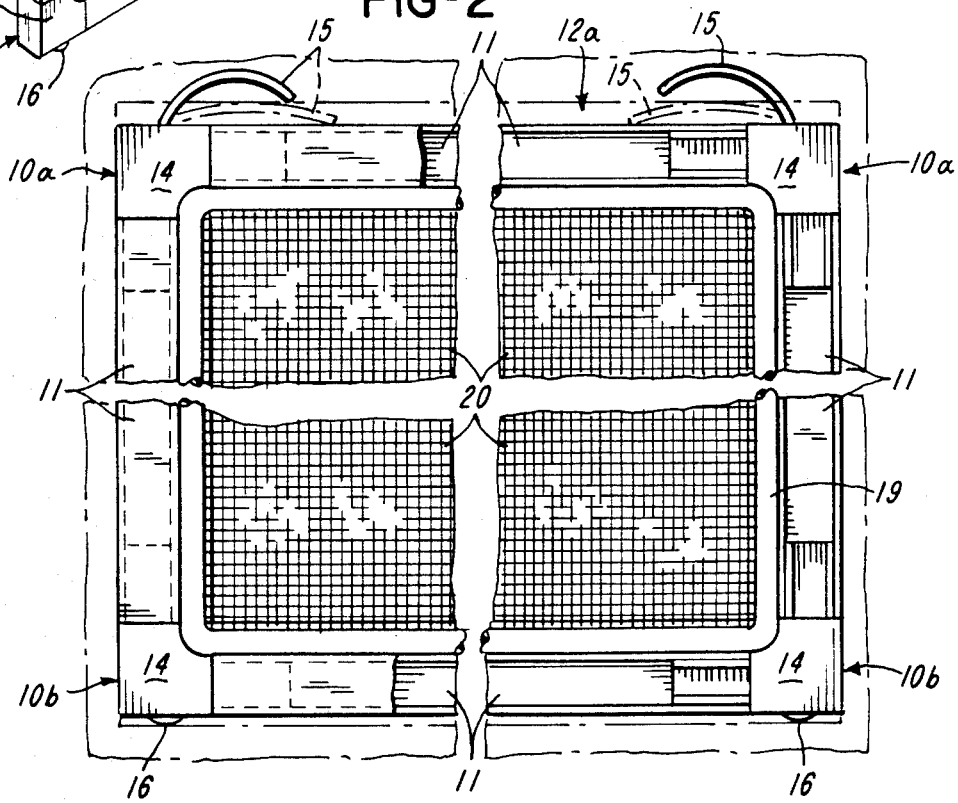
FIG. 2 is a fragmentary plan view of the window screen shown in FIG. 1 to particularly illustrate the normally uncompressed position of a resilient finger of the device of this invention. And the compressed position of a resilient finger caused by the placement of the window screen within a window frame is shown by dash lines.

In order to provide a temperature and humidity equilibrium between the frame assembly and the window frame projecting downwardly from junction member 14 is a hemispherically-shaped nipple 16, a pair of which are located at the two lowermost corners of frame assembly 12*a*. In this embodiment of the device of the invention corner fastener 10*b* is best seen in the perspective view of FIG. 4.

Adjoining to, but preferably as a part of one of the cross members of tubular member 11 and extending the entire length of tubular member 11 is L-shaped member 17 forming with such cross member a U-shaped channel 18. A spline 19 fabricated from a suitable material such as polyvinyl chloride, nylon, or the like is adapted for disposition within U-shaped channel 18 to further effect the securement of tubular members 11 to one another and in some embodiments of the invention the concomitant securement of a wire or fabric screen 20 to frame assembly 12*b*.

Figure 5:
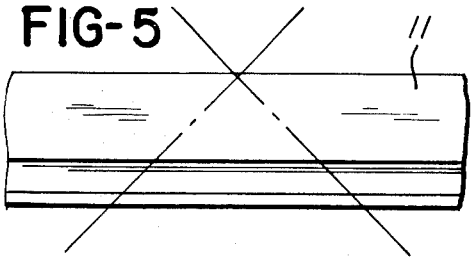
FIG. 5 is a plan view of a portion of an elongated tubular body illustrating by dash lines the position of angular cuts required in the miter joining of the resulting two cut pieces and the scrap material produced therefrom.
Figure 6:
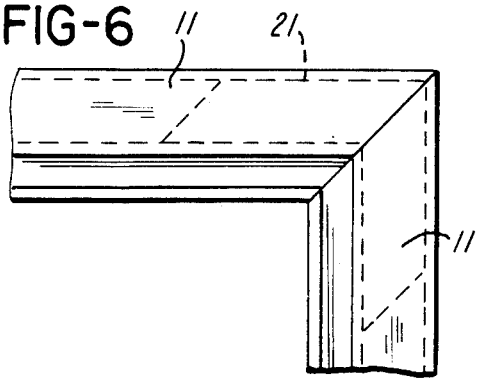
FIG. 6 is a plan view of the mitered tubular pieces of FIG. 5 to particularly illustrate by dash lines an internal key used to connect the pieces to each other.
Figure 7:
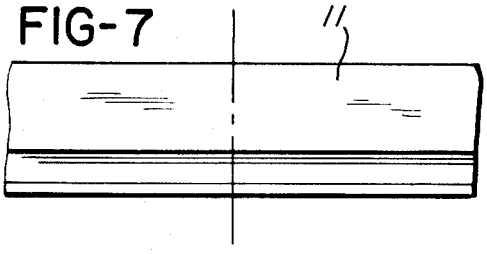
FIG. 7 is a plan view of a portion of an elongated tubular body illustrating by dash lines the position of the cross cut required in the corner joining of the resulting two cut pieces by means of the device of this invention.
Figure 8:
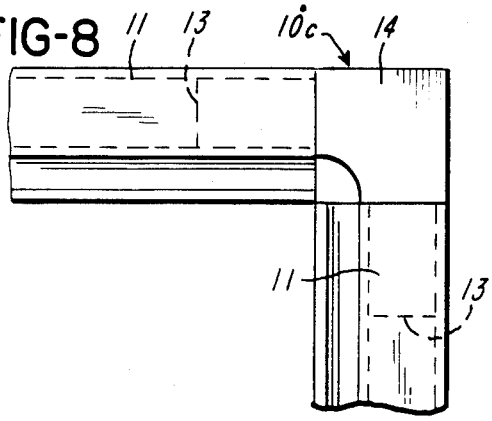
FIG. 8 is a plan view of the tubular pieces of FIG. 7 corner joined by still another form of the device of this invention.

Referring to FIGS. 5 and 6, the prior art method of miter joining elongated tubular member 11 is illustrated whereby tubular member 11 is twice-cut to produce two angled pieces that are secured to each other with an internal key 21. Contrastingly, in FIGS. 7 and 8 the instant method of joining elongated tubular member 11 is illustrated whereby tubular member 11 is once-cut to produce two square pieces that are secured with corner fastener 10*c* with junction member 14 forming a right angle corner and with pair of legs 13 securing tubular members 11 to corner fastener 10*c* and concomitantly securing tubular member 11 to one another.

Figure 9:
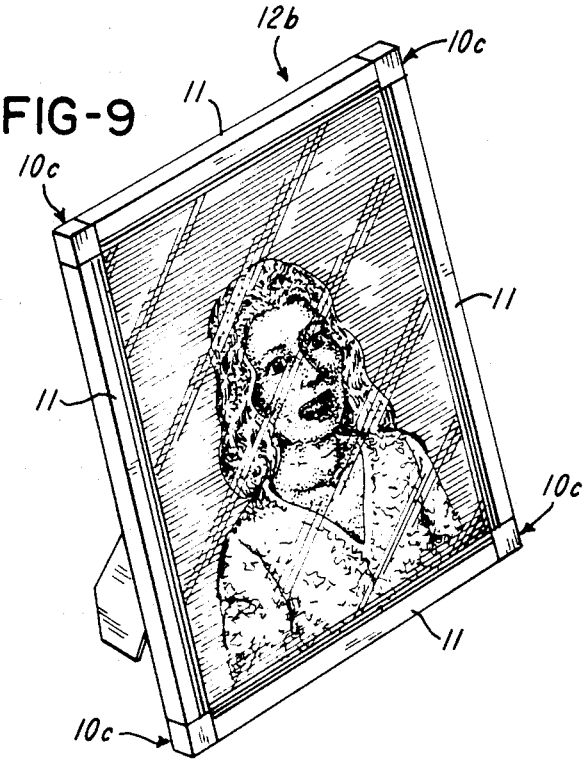
FIG. 9 is a perspective view showing the device of this invention used in the construction of a picture frame.
Figure 10:
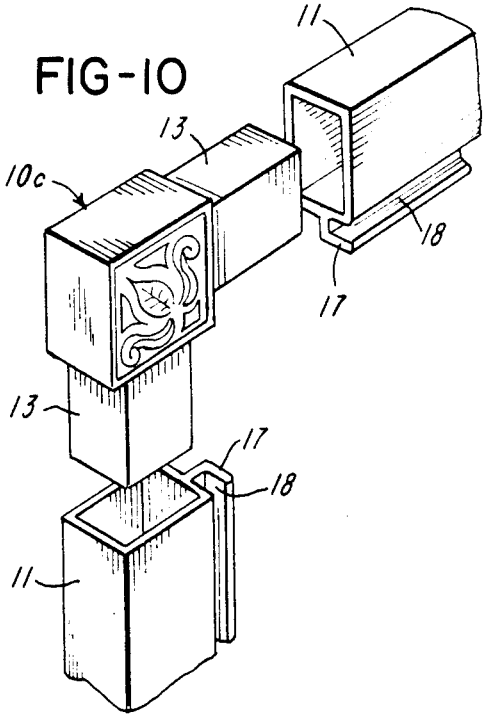
FIG. 10 is an exploded perspective view of the device of this invention used in the construction of a corner of the picture frame shown in FIG. 9.

Referring to FIGS. 9 and 10, an alternate aspect of an embodiment of the device of this invention is illustrated whereby corner fastener 10*c* is used to secure tubular member 11 to one another to form frame assembly 12*b* but has neither resilient finger 15 nor hemispherically-shaped nipple 16 projecting from junction member 14. The surfaces of junction member 14 of corner fastener 10*c* may be plain without ornamentation or alternately may be embelished with an ornamental design as seen in FIG. 10.

While the within invention has been described as required by law in connection with certain preferred embodiments thereof, it is to be understood that the foregoing particularization and detail have been for the purposes of description and illustration only and do not in any way limit the scope of the invention as it is more precisely defined in the subjointed claims.

What is claimed is:

1. A corner fastener for use in forming a frame assembly by interconnecting at a predetermined angle elongated tubular members having a hollow internal space of a predetermined and generally rectangular cross sectional area comprising a pair of legs at such predetermined angle with respect to each other connected to a junction member, each of the legs being adapted for disposition within the interior of the elongated tubular members and being of such a cross sectional area so as to substantially and securely fill the internal space of the elongated tubular members, the junction member being of such configuration so as to be contiguous with the outer walls of the tubular members, and the junction member having a resilient finger projecting outwardly and curving medially to effect securement of the frame assembly to a window frame.

2. A corner fastener according to claim 1 characterized as being fabricated from a plastic material.

3. A corner fastener according to claim 1 characterized as being fabricated from a metal.

4. A corner fastener according to claim 1 wherein said predetermined angle is a right angle.

5. A corner fastener according to claim 1 wherein said junction member is shouldered to stop elongated tubular member.

6. A corner fastener for use in forming a frame assembly by interconnecting at a predetermined angle elongated tubular members having a hollow internal space of a predetermined and generally rectangular cross sectional area comprising a pair of legs at such predetermined angle with respect to each other connected to a junction member, each of the legs being adapted for disposition within the interior of the elongated tubular members and being of such a cross sectional area so as to substantially and securely fill the internal space of the elongated tubular members, the junction member being of such configuration so as to be contiguous with the outer walls of the tubular members, and the junction member having a generally hemispherically-shaped nipple projecting outwardly to provide sufficient clearance between the frame assembly and window frame to maintain a temperature and humidity equilibrium.

7. A corner fastener according to claim 6 characterized as being fabricated from a plastic material.

8. A corner fastener according to claim 6 characterized as being fabricated from a metal.

9. A corner fastener according to claim 6 wherein said predetermined angle is a right angle.

10. A corner fastener according to claim 6 wherein said junction member is shouldered to stop elongated tubular member.

11. A frame assembly formed by interconnecting at a predetermined angle elongated tubular members having a hollow internal space of a predetermined and generally rectangular cross sectional area and extending from the tubular member and for its entire length is an L-shaped member which in turn forms with the tubular member a U-shaped channel, adapted for disposition within the U-shaped channel is a spline to effect the securement of tubular members, the improvement comprising a corner fastener having a pair of legs at such predetermined angle with respect to each other connected to a junction member, each of the legs being adapted for disposition within the interior of the elongated tubular members and being of such cross sectional area so as to substantially and securely fill the internal space of the elongated tubular members, the junction member being of such configuration so as to be contiguous with the outer walls of the tubular members, and the first and second junction members each having a resilient finger projecting outwardly and curving medially to effect securement of the frame assembly to a window frame, and the third and fourth junction members each having a generally hemispherically-shaped nipple projecting outwardly to provide sufficient clearance between the frame assembly and window frame to maintain a temperature and humidity equilibrium.

12. A corner fasterner according to claim 11 characterized as being fabricated from a plastic material.

13. A corner fastener according to claim 11 characterized as being fabricated from a metal.

14. A corner fastener according to claim 11 wherein said predetermined angle is a right angle.

15. A corner fastener according to claim 11 wherein said junction member is shouldered to stop elongated tubular member.

* * * * *